US009885294B2

(12) United States Patent
Park

(10) Patent No.: US 9,885,294 B2
(45) Date of Patent: Feb. 6, 2018

(54) METHOD FOR CONTROLLING RPM OF CONSTRUCTION MACHINE ENGINE

(71) Applicant: DOOSAN INFRACORE CO., LTD., Incheon (KR)

(72) Inventor: Jun Hong Park, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 122 days.

(21) Appl. No.: 14/369,012

(22) PCT Filed: Dec. 18, 2012

(86) PCT No.: PCT/KR2012/011055
§ 371 (c)(1),
(2) Date: Jun. 26, 2014

(87) PCT Pub. No.: WO2013/100471
PCT Pub. Date: Jul. 4, 2013

(65) Prior Publication Data

US 2014/0343829 A1 Nov. 20, 2014

(30) Foreign Application Priority Data

Dec. 28, 2011 (KR) ..... 10-2011-0144421

(51) Int. Cl.
*F02D 29/02* (2006.01)
*F02D 41/02* (2006.01)
(Continued)

(52) U.S. Cl.
CPC ..... *F02D 29/02* (2013.01); *F02D 41/021* (2013.01); *F02D 41/083* (2013.01); *F02D 31/008* (2013.01)

(58) Field of Classification Search
CPC ..... F02D 29/02; F02D 31/008; F02D 41/021; F02D 41/083; F02D 41/08; F02D 11/02; F02D 1/02; F02D 11/10; F02D 29/00
(Continued)

(56) References Cited

U.S. PATENT DOCUMENTS 3,562,487 A * 2/1971 Nelson ..... B23K 9/0732 219/130.32
4,553,516 A * 11/1985 Hasegawa ..... F02D 29/06 123/438
(Continued)

FOREIGN PATENT DOCUMENTS

JP H05-033701 2/1993
JP 2004-339956 12/2004
(Continued)

OTHER PUBLICATIONS

Search Report dated Mar. 6, 2013 and written in Korean with English translation for International Patent Application No. PCT/KR2012/011055 filed Dec. 18, 2012, 5 pages.

*Primary Examiner* — Carlos A Rivera
*Assistant Examiner* — Carl Staubach
(74) *Attorney, Agent, or Firm* — John D. Veldhuis-Kroeze; Westman, Champlin & Koehler, P.A.

(57) ABSTRACT

According to the present disclosure, there is provided a method for controlling an RPM of an engine of construction machinery, including and converting and setting the received load factor to a load variation rate; receiving a current load factor of the engine and converting the received current load factor of the engine to a load variation rate; controlling driving of the engine with a corrected RPM, which is obtained by decreasing the RPM of the engine by a predetermined rate from a preset RPM when the current load factor of the engine and the load variation rate according to the current load factor are equal to or smaller than a (Continued)

predetermined rate of the predetermined load factor of the engine and a predetermined rate of the load variation rate for a first time, respectively; and controlling continuously decreasing the corrected RPM to a predetermined rate or smaller, when the current load factor of the engine and the load variation rate according to the current load factor are equal to or smaller than the predetermined rate of the predetermined load factor of the engine and the predetermined rate of the load variation rate for a second time, respectively.

8 Claims, 2 Drawing Sheets

(51) Int. Cl.
*F02D 41/08* (2006.01)
*F02D 31/00* (2006.01)

(58) Field of Classification Search
USPC ..... 701/103, 104, 110; 123/319, 339.1, 123/339.11–339.29
See application file for complete search history.

(56) References Cited

U.S. PATENT DOCUMENTS 4,719,573 A * 1/1988 Kissel ..... F02D 31/005 123/339.11
4,838,755 A * 6/1989 Johnson ..... E02F 9/2232 123/385
5,705,735 A * 1/1998 Acorn ..... A61B 5/083 128/204.23
5,878,711 A * 3/1999 Kamura ..... F02D 31/008 123/295
5,998,881 A * 12/1999 Wind ..... F02D 41/083 123/339.1
6,573,614 B2 * 6/2003 Doll ..... H02J 7/1476 290/40 C
6,883,495 B1 * 4/2005 Strauss ..... F02D 41/083 123/339.1
7,085,645 B2 * 8/2006 Matsuda ..... F02D 31/002 123/350
7,353,105 B2 * 4/2008 Mino ..... F02D 31/007 123/350
7,952,231 B1 * 5/2011 Zansky ..... H02J 7/34 307/44
8,463,527 B2 * 6/2013 Thorsen ..... F02D 41/0205 123/339.13
8,869,928 B2 * 10/2014 Yoshida ..... F01N 3/0231 180/305
9,328,481 B2 * 5/2016 McKee ..... E02F 9/085
9,581,090 B2 * 2/2017 Yun ..... F02D 31/001
2003/0089106 A1 * 5/2003 Ioku ..... E02F 9/2239 60/328
2006/0192533 A1 * 8/2006 Kimura ..... F02D 29/02 322/22
2008/0034748 A1 * 2/2008 Koo ..... E02F 9/2239 60/484
2010/0193272 A1 * 8/2010 Jacobsen ..... F02D 41/083 180/69.3
2011/0010058 A1 * 1/2011 Saito ..... B60W 30/182 701/50
2013/0190994 A1 * 7/2013 Narazaki ..... F02D 29/00 701/50
2016/0040610 A1 * 2/2016 Sohn ..... F02D 41/021 123/339.14

FOREIGN PATENT DOCUMENTS

KR 10-0702178 4/2007
KR 10-2010-0075339 7/2010

* cited by examiner

METHOD FOR CONTROLLING RPM OF CONSTRUCTION MACHINE ENGINE

CROSS-REFERENCE TO RELATED APPLICATION

This Application is a Section 371 National Stage Application of International Application No. PCT/KR2012/011055, filed Dec. 18, 2012 and published, not in English, as WO 2013/100471 on Jul. 4, 2013.

FIELD OF THE DISCLOSURE

The present disclosure relates to a method for controlling an RPM of an engine of construction machinery, and more particularly, to a method for controlling an RPM of an engine of construction machinery, which is capable of continuously controlling an RPM of an engine of construction machinery so that the RPM of the engine of the construction machinery is equal to or smaller than a predetermined rate in an idle RPM state when a variation in a load factor of the engine is continuously equal to or smaller than a predetermined rate for a predetermined load factor within a predetermined time.

BACKGROUND OF THE DISCLOSURE

In general, when construction machinery is started begins and an operation thereof begins, an engine is driven with about 2000 RPM to 2500 RPM, and when the operation is completed, that is, there is no continuous operation after a predetermined time from a time at which the operation is completed, a vehicle control unit performs an idle control of decreasing the RPM of the engine to about 1200 RPM.

Further, when a separate front operation, steering operation, or manipulation for driving is not generated for a predetermined time in the state where the idle control is performed, the vehicle control unit also determines this situation as the idle state to perform an auto idle control of decreasing the RPM of the engine to about 800 RPM so that the engine is driven with a minimum RPM.

As described above, the construction machinery is controlled so that the control is performed so as to change an operation RPM to an idle RPM according to existence of the operation state, and the control is performed so as to change an idle RPM to an auto idle RPM according to existence of the idle state to drive the engine.

In the meantime, recently, as becoming an age of high oil price, demands for improving fuel efficiency of construction equipment have been gradually on the rise.

Accordingly, development of a technology for improving an effect of fuel efficiency by decreasing an RPM of the engine when the idle state is continued even in the auto idle state, as well as the existence of the operation state and the idle state, has been urgently demanded.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

The present disclosure is conceived in order to solve the aforementioned problems, and an object of the present disclosure is to provide a method for controlling an RPM of an engine of construction machinery, which is capable of continuously controlling an RPM of an engine of construction machinery so that an RPM of the engine of the construction machinery is equal to or smaller than a predetermined rate in an idle RPM state when a variation in a load factor of the engine of the construction machinery is continuously equal to or smaller than a predetermined rate for a predetermined load factor within a predetermined time.

However, an object of the present disclosure is not limited to the aforementioned objects, and those skilled in the art will clearly understand non-mentioned other objects through the following description.

In order to achieve the above object, the present disclosure provides a method for controlling an RPM of an engine of construction machinery, including: controlling an RPM of the engine so that the RPM of the engine corresponds to a set RPM; receiving a load factor of the engine according to the set RPM of the engine, and converting and setting the received load factor to a load variation rate; receiving a current load factor of the engine when an auto idle control function is selected, and converting the received current load factor of the engine to a load variation rate; controlling driving of the engine with a corrected RPM, which is obtained by decreasing the RPM of the engine by a predetermined rate from a preset RPM when the current load factor of the engine and the load variation rate according to the current load factor are equal to or smaller than a predetermined rate of the predetermined load factor of the engine and a predetermined rate of the load variation rate for a first time, respectively; and controlling the driving of the engine with a corrected RPM, which is obtained by continuously decreasing the corrected RPM by a predetermined rate or smaller, when the current load factor of the engine and the load variation rate according to the current load factor are equal to or smaller than the predetermined rate of the predetermined load factor of the engine and the predetermined rate of the load variation rate for a second time, respectively, during the performance of the RPM control.

According to the aforementioned method for controlling an RPM of an engine of construction machinery, in the state where an RPM of the engine of the construction machinery is decreased to be the idle RPM, when a load factor variation of the engine is equal to or smaller than a predetermined rate of an initial load factor for a predetermined time in the state where the RPM of the engine is converted to the idle RPM, the RPM of the engine of the construction machinery is continuously controlled with the predetermined rate or smaller in the idle RPM state, so that the engine may be driven with a predetermined RPM only in the state where the load is actually required.

However, an effect of the present disclosure is not limited to the aforementioned matters, and those skilled in the art will clearly understand non-mentioned other effects through the description of the accompanying claims.

DETAILED DESCRIPTION

Hereinafter, an exemplary embodiment of the present disclosure will be described in detail with reference to the accompanying drawings.

Figure 1:
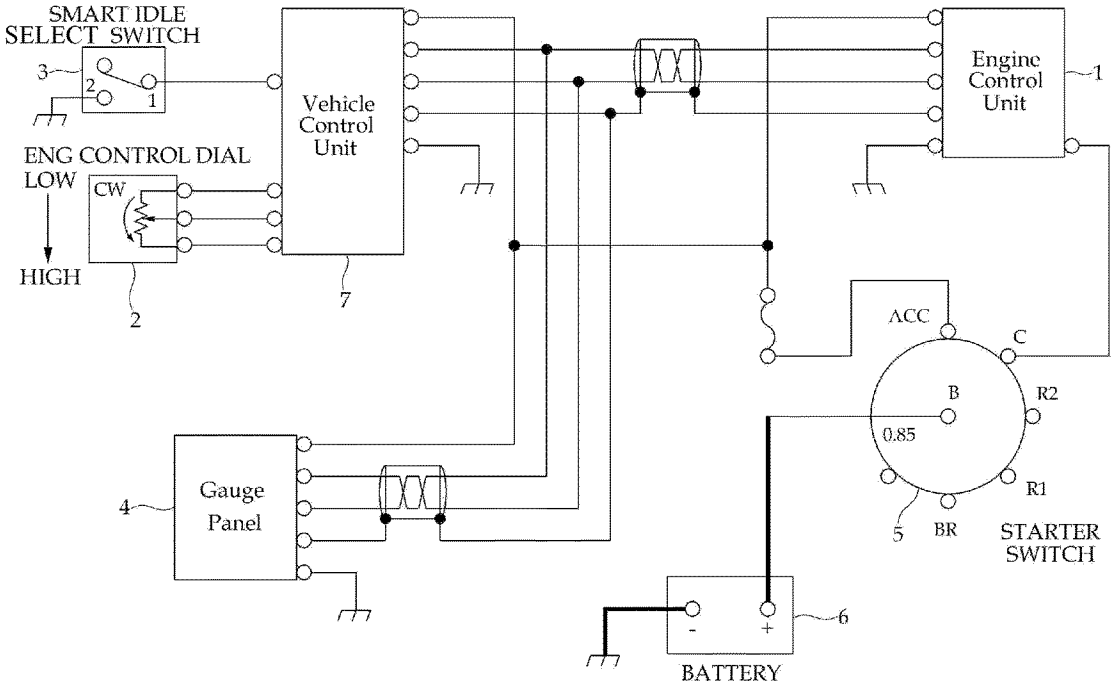
FIG. 1 is a configuration diagram illustrating a system for controlling an RPM of an engine of construction machinery according to an exemplary embodiment of the present disclosure.
Figure 2:
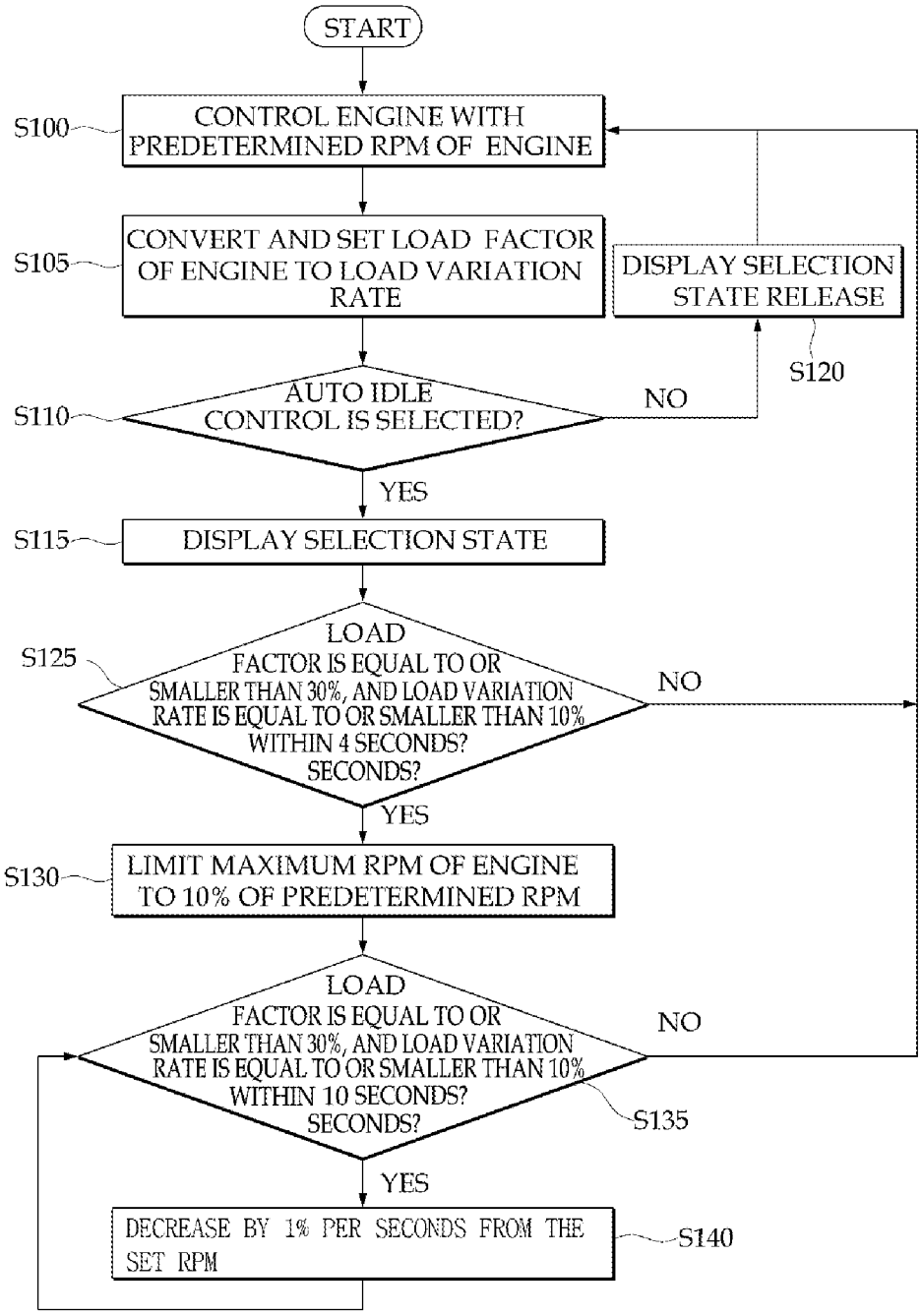
FIG. 2 is a control flowchart illustrating a method for controlling an RPM of an engine of construction machinery according to an exemplary embodiment of the present disclosure.

FIG. 1 is a configuration diagram illustrating a system for controlling an RPM of an engine of construction machinery according to an exemplary embodiment of the present disclosure, and FIG. 2 is a control flowchart illustrating a method for controlling an RPM of an engine of construction machinery according to an exemplary embodiment of the present disclosure.

As illustrated in FIG. 1, a system for controlling an RPM of an engine of construction machinery according to an exemplary embodiment of the present disclosure includes an engine control unit 1 for controlling the engine according to existence of a front operation, existence of a steering operation, existence of a pedal operation, and the like, an engine control dial 2 for allowing a user to set an operation RPM of the engine, an idle switch 3 for allowing the user to select an auto idle control function, a gauge panel 4 for displaying the auto idle control function to the user when the auto idle control function is selected by the idle switch 3, a start switch 5 for allowing the user to input a signal related to starting of the construction machinery, a battery 6 for supplying an operation power source to the constructional elements when the signal of the start switch 5 is input, and a vehicle control unit 7 for generating a control signal to the engine control unit 1 so that the control signal corresponds to the operation RPM of the engine set by the user, receiving a current load factor of the engine when the auto idle control function is selected and converting and setting the received current load factor of the engine to a current moment load factor, controlling the RPM so that the RPM of the engine becomes an RPM having a predetermined rate or smaller of the operation RPM of the engine when the current load factor of the engine becomes a load factor equal to or smaller than a predetermined rate for the set load factor for a predetermined time, and then decreasing the RPM of the engine from the previously calculated RPM with a predetermined rate per second when the load of the engine continuously has the load factor having the predetermined rate or smaller for the set load factor for a predetermined time.

Here, the engine control unit 1 determines whether the operation of the construction machinery based on the signal from a front operation detection sensor, a steering operation detection sensor, a pedal operation detection sensor, and the like, and controls the driving of the engine according to a control signal input from the vehicle control unit 7.

The engine control dial 2 allows the user to set the operation RPM of the engine, so that the engine of the construction machinery is operated within a predetermined range of RPM during the operation or travel.

The idle switch 3 allows the user to select the auto idle control function, and when the operation or travel is in an idle state for a predetermined time, the idle switch 3 may enable the RPM of the engine of the construction machinery to be decreased to an idle RPM or a high idle RPM, thereby improving fuel efficiency.

The gauge panel 4 is a display means for displaying information about the auto idle control function to the user when the auto idle control function is selected by the idle switch 3, and displays travel information necessary for the operation of the construction machinery, and other information to enable the user to recognize a state of the corresponding construction machinery.

The vehicle control unit 7 is a control means for controlling the RPM of the engine to be decreased to the set idle RPM or the high idle RPM when an idle state of the vehicle is continued in the operation RPM of the engine when the auto idle control function is selected.

Here, the vehicle control unit 7 displays information about the auto idle control function to the user when the auto idle control function is selected. The vehicle control unit 7 receives a load factor of the engine and measures a moment load factor, and when a load factor for 4 seconds is equal to or smaller than 30% of the set load factor, and a moment load factor (or a load variation rate) for 4 seconds is equal to or smaller than 10% of the measured moment load factor, the vehicle control unit 7 subsequently performs a control of decreasing the RPM of the engine to be a corrected RPM which is set to 90% of the high idle RPM or the idle RPM.

Since the performance of the control of the idle RPM, when the load factor is continuously equal to or smaller than 30% of the set load factor, and the moment load factor (or the load variation rate) for 10 seconds is equal to or smaller than 10% of the set moment load factor after the performance of the control of the idle RPM, the vehicle control unit 7 continuously controls so that the operation of the engine is further decreased by 1% per second from the operation RPM.

Hereinafter, a method for controlling an RPM of an engine of construction machinery according to an exemplary embodiment of the present disclosure will be described with reference to the accompanying drawings.

First, as illustrated in FIGS. 1 and 2, in a method for controlling an RPM of an engine of construction machinery according to an exemplary embodiment of the present disclosure, an operation RPM or a working RPM of the engine is set from the engine control dial 2, so that the engine control unit 1 controls the RPM of the engine according to the control of the vehicle control unit 7 (S100).

Then, the vehicle control unit 7 receives the current load factor of the engine from the engine control unit 1, and the vehicle control unit 7 converts and the set receives the current load factor to a moment load factor (S105).

Then, the vehicle control unit 7 determines whether the user selects the auto idle control function through the idle switch 3 (S110), and displays an information about idle control function selection state on the gauge panel 4 when the auto idle control function is selected in step S110 (S115), and displays idle function selection state release on the gauge panel 4 and then performs step S100 when the auto idle control function is not selected in step S110 (S120).

Further, after step S115, the vehicle control unit 7 receives the current load factor of the engine from the engine control unit 1, and subsequently, the vehicle control unit 7 determines whether the current load factor of the engine is equal to or smaller than 30% of the set load factor, and a load variation rate, with which the current load factor of the engine is converted, is equal to or smaller than 10% of the set load variation rate within 4 seconds (S125).

When the current load factor of the engine is equal to or smaller than 30% of the set load factor, and the load variation rate, with which the current load factor of the engine is converted, is equal to or smaller than 10% of the set load variation rate within four seconds in step S125, the vehicle control unit 7 controls the RPM so that a maximum RPM of the engine is limited to be equal to or smaller than 90% of a predetermined corrected engine RPM (an idle RPM or a high idle RPM) (S130), and otherwise, the vehicle control unit 7 performs step S100.

Then, the vehicle control unit 7 determines whether the current load factor of the engine is equal to or smaller than 30% of the set load factor, and the load variation rate, with which the current load factor of the engine is converted, is continuously equal to or smaller than 10% of the set load variation rate within 10 seconds (S135).

When the current load factor of the engine is equal to or smaller than 30% of the set load factor, and the load variation rate, with which the current load factor of the engine is converted, is equal to or smaller than 10% of the set load variation rate for or within 10 seconds in step S135, the vehicle control unit 7 controls the RPM so that the vehicle control unit 7 limits the corrected RPM of the engine to be equal to or smaller than 10% of the predetermined operation RPM or working RPM, and simultaneously controls the auto idle RPM of decreasing the RPM of the engine by 1% per second, the vehicle control unit 7 performs step S135 (S140), and otherwise, the vehicle control unit 7 performs step S100.

Accordingly, according to the method for controlling the RPM of the engine of the construction machinery, the load factor of the engine is received, and the received load factor of the engine is converted and set to the moment load factor, when the load factor has a predetermined rate or smaller for the set load factor for a predetermined time, the RPM of the engine is controlled to be the idle RPM so that the RPM of the engine becomes an RPM having a predetermined rate or smaller of the operation RPM of the engine, and then when the load of the engine has a load factor having a predetermined rate or smaller for the set load factor for a predetermined time, the RPM of the engine is controlled to have an RPM corresponding to the idle RPM, and simultaneously the idle RPM is continuously controlled to be the auto idle RPM, in which the idle RPM is decreased by 1% for each second, so that it is possible to prevent information error according to a mechanical method from being generated, solve a mechanical defect according to the error generation, and decrease manufacturing cost, compared to the auto idle RPM control of checking a hydraulic change through a pressure switch, a pressure sensor, and the like in the related art.

Although the exemplary embodiments of the present disclosure have been described with reference to the accompanying drawings, those skilled in the art will appreciate that various substitutions, modifications, and changes are possible, without departing from the technical spirit or the essential feature of the disclosure, so that the exemplary embodiments may be implemented to other particular forms. Therefore, it shall be understood that the aforementioned exemplary embodiments are all illustrative and are not restrictive.

The present disclosure may be easily implemented without a constructional change, and an effect by the implementation is obvious, so that the present disclosure may be highly usable in construction machinery.

The invention claimed is:

1. A method, comprising:

controlling an RPM of an engine of construction machinery so that the RPM of the engine corresponds to an operation RPM set by a user;

receiving and setting a load factor of the engine according to the operation RPM of the engine to a set load factor;

converting and setting the received load factor to a set moment load factor;

receiving a current load factor of the engine when an auto idle control function is selected;

converting the received current load factor of the engine to a current moment load factor;

controlling a driving of the engine with a previous corrected RPM, which is obtained by decreasing the RPM of the engine by a predetermined value from a preset RPM when the current load factor of the engine and the current moment load factor are equal to or smaller than a predetermined value of the set load factor of the engine and a predetermined value of the set moment load factor for a first time, respectively;

controlling a driving of the engine with a next corrected RPM, which is obtained by continuously decreasing the RPM of the engine by a predetermined value from the previous corrected RPM by a predetermined value or smaller, when the current load factor of the engine and the current moment load factor are respectively equal to or smaller than the predetermined value of the set load factor of the engine and the predetermined value of the set moment load factor for a second time, after the controlling of the previous corrected RPM; and repeating the controlling a driving of the engine with a next corrected RPM until the current load factor of the engine and the current moment load factor are respectively more than the predetermined value of the set load factor of the engine and the predetermined value of the set moment load factor for the second time, wherein when the current load factor of the engine and the current moment load factor are respectively more than the predetermined value of the set load factor of the engine and the predetermined value of the set moment load factor for the second time, after the controlling of the previous corrected RPM or the next corrected RPM, going back to controlling the RPM of the engine.

2. The method of claim 1, wherein whether the current load factor of the engine and the current moment load factor according to the current load factor are equal to or smaller than 30% of the set load factor of the engine and 10% of the set moment load factor, respectively, is determined.

3. The method of claim 1, wherein the continuously decreasing the previous corrected RPM includes decreasing the RPM of the engine by 1% per second.

4. The method of claim 1, further comprising receiving selection of the auto idle control function of the engine from an operator input part.

5. The method of claim 1, further comprising displaying information regarding a state of the engine while the auto idle control function is selected.

6. A system, comprising:

an engine of construction machinery;

an operator input part configured to receive and provide selection of an auto idle control function of the engine and to set an operation RPM of the engine;

an operator output part configured to provide information regarding a state of the engine while the auto idle control function is selected; and a control unit configured to:

control an RPM of the engine so that the RPM of the engine corresponds to the operation RPM set by user;

receive and set a load factor of the engine according to the operation RPM of the engine to a set load factor;

convert and set the received load factor to a set moment load factor;

receive a current load factor of the engine when the auto idle control function is selected through the operator input part;

convert the received current load factor of the engine to a current moment load factor;

control a driving of the engine with a previous corrected RPM, which is obtained by decreasing the RPM of the engine by a predetermined value from a preset RPM when the current load factor of the engine and the current moment load factor are equal to or smaller than a predetermined value of the set load factor of the engine and a predetermined value of the set moment load factor for a first time, respectively;

control a driving of the engine with a next corrected RPM, which is obtained by continuously decreasing the previous corrected RPM by a predetermined value or smaller, when the current load factor of the engine and the current moment load factor are respectively equal to or smaller than the predetermined value of the set load factor of the engine and the predetermined value of the set moment load factor for a second time, after the controlling of the previous corrected RPM; and repeat to control a driving of the engine with a next corrected RPM, which is obtained by continuously decreasing the previous corrected RPM by a predetermined value or smaller, wherein when the current load factor of the engine and the current moment load factor are respectively more than the predetermined value of the set load factor of the engine and the predetermined value of the set moment load factor for the second time, after the controlling of the previous corrected RPM or the next corrected RPM, go back to control the RPM of the engine.

7. The system of claim 6, wherein whether the current load factor of the engine and the current moment load factor according to the current load factor are equal to or smaller than 30% of the set load factor of the engine and 10% of the set moment load factor, respectively, is determined.

8. The system of claim 6, wherein the continuously decreasing the previous corrected RPM includes decreasing the RPM of the engine by 1% per second.

* * * * *